United States Patent [19]

Blacker et al.

[11] 4,253,041

[45] Feb. 24, 1981

[54] EXTENDED FIELD ELECTRON GUN HAVING A SYNTHESIZED AXIAL POTENTIAL

[75] Inventors: Allen P. Blacker, Hoffman Estates; Arthur J. Ingle, Bartlett, both of Ill.

[73] Assignee: Zenith Radio Corporation, Glenview, Ill.

[21] Appl. No.: 67,487

[22] Filed: Aug. 16, 1979

[51] Int. Cl.[3] ..... H01J 29/46; H01J 29/56

[52] U.S. Cl. ..... 315/16; 313/414

[58] Field of Search ..... 315/16, 382; 313/414, 313/449

[56] References Cited

U.S. PATENT DOCUMENTS

| | | |
|---|---|---|
| 2,859,378 | 11/1958 | Gundert et al. |
| 3,651,359 | 3/1972 | Miyaoka . |
| 3,702,950 | 11/1972 | Nakamura . |
| 3,895,253 | 7/1975 | Schwartz et al. |
| 3,932,786 | 1/1976 | Campbell . |
| 3,995,194 | 11/1976 | Blacker, Jr. et al. |

OTHER PUBLICATIONS

A. B. El-Kareh, *Electron Beams, Lenses, and Optics*, Academic Press, vol. 1, 1970, pp. 32–41.

*Primary Examiner*—Theodore M. Blum

[57] ABSTRACT

An electron gun for a television cathode ray tube is disclosed having cathode means and grid means for producing a beam of electrons. A low-aberration, low-magnification main focus lens means comprising at least three electrodes receives a predetermined pattern of applied voltages to establish a single, continuous electrostatic field having an axial potential distribution which, at all times during tube operation, decreases smoothly and monotonically from a relatively intermediate axial potential to a relatively low-intermediate axial potential spatially located at a lens intermediate position. The axial potential then increases smoothly, directly and monotonically from the relatively low intermediate axial potential to a relatively high axial potential. The gun is characterized by the synthesizing of the relatively low-intermediate axial potential by electrode means comprising a composite electrode made up of an odd-number plurality of apertured elements separated by gaps. The even-numbered ones of the elements have the relatively intermediate applied voltage thereon, and the odd-numbered ones of the elements have a relatively low applied voltage thereon. The spacing of the elements of the composite electrode, and the number of the elements, the aperture size and configurations of the elements, and the periodic applied voltages thereon are such as to produce the relatively low-intermediate axial potential in non-periodic form at the lens intermediate position.

11 Claims, 9 Drawing Figures

EXTENDED FIELD ELECTRON GUN HAVING A SYNTHESIZED AXIAL POTENTIAL

CROSS REFERENCE TO RELATED APPLICATION

This application is related to but in no way dependent upon application Ser. No. 694,614, filed June 10, 1976, of common ownership herewith.

BACKGROUND OF THE INVENTION AND PRIOR ART STATEMENT

This invention relates in general to electron guns for television cathode ray picture tubes, and more specifically to an improved extended field main focus lens for such guns.

The focus lens provided according to the present invention represents a new and useful improvement of the electron gun having an extended field electrostatic focus lens described and fully claimed in U.S. Pat. No. 3,995,194 to Blacker et al, and assigned to the assignee of the present invention. The subject Blacker et al patent, hereinafter referred to as the "'194" patent and incorporated herein by reference, entails a television cathode ray tube having associated therewith a power supply for developing discrete supply voltages. A general purpose electron gun is provided for receiving supply voltages from the power supply to produce a sharply focused beam of electrons at the cathode ray tube screen. The gun according to the '194 patent comprises associated cathode means and grid means for producing a beam of electrons, and a novel focus lens means. The focus lens means receives electrons from the cathode means and the predetermined pattern of voltages from the power supply and comprises at least three electrodes for establishing a single, continuous electrostatic focusing field characterized by having an axial potential distribution which, at all times during tube operation, decreases smoothly and monotonically from a relatively intermediate potential to a relatively low potential spatially located at a lens intermediate position, and then increases smoothly, directly and monotonically from the relatively low potential to a relatively high potential. This novel axial potential distribution is represented diagrammatically by FIG. 1.

The novel focus lens set forth by the '194 patent takes advantage of the low aberration produced by the extended field lens described and claimed in U.S. Pat. No. 3,985,253 to J. Schwartz et al. The extended field provides reduced beam spot size even at high beam currents, and thus offers markedly improved picture resolution in all screen sizes.

The structure and relationship of an electron gun of the type described and a cathode ray picture tube, and the prior art means for supplying operating voltages to the combination, are shown by FIG. 2. The primary components of a typical color picture tube 10 comprise an evacuated envelope including a neck 12, a funnel 14 and a faceplace 16. On an inner surface of the faceplate 16 are deposited a multiplicity of cathodoluminescent phosphor target elements 18 comprising a pattern of groups of red-light-emitting, green-light-emitting, and blue-light-emitting dots or stripes. A foraminated electrode 20 called a "shadow mask", is used in the tube for color selection. Base 22 provides entrance means for a plurality of electrically conductive lead-in pins 24.

The electron gun 26, illustrated schematically, is disposed within neck 12 substantially as shown. Gun 26 is commonly installed in axial alignment with a center line X—X of picture tube 10. Gun 26 emits electron beams 28 to selectively activate target elements 18.

Power supply 30, also shown schematically, provides voltages for operation of the cathode ray tube and its electron gun. To supply the required potentials, a special voltage divider circuit is typically incorporated into the power supply circuit. Power supply 30 may supply relatively low voltages in the one to eight kilovolt range through one or more leads represented schematically by 32, which enter the envelope of tube 10 through the plurality of lead-in pins 24 in base 22. Power supply 30 also supplies selected intermediate voltages to the focus electrodes of electron gun 26, voltages typically in the range of eight to fifteen kilovolts or higher; these voltages are indicated as being supplied to the electrodes within the envelope of tube 12 by way of lead-in pins 24 through lead 33. The relatively high voltage for electron gun operation; this is, a voltage typically in the range of twenty-five to thirty-five kilovolts for excitation of the accelerating anodes is shown as being indirectly supplied to gun 26 through lead 34, which is connected to anode button 36. Anode button 36 in turn introduces the high voltage through the glass envelope of funnel 14, making contact with a thin, electrically conductive coating 38 disposed on the internal surface of funnel 14, and part-way into neck 12. The anode electrode of gun 26 receives the relatively high anode voltage through a plurality of metallic gun centering springs 40 extending from gun 26 and in physical contact with inner conductive coating 38.

The requirement to introduce the relatively low voltage of about 8 kilovolts together with the relatively intermediate voltage of about 12 kilovolts into the cathode ray tube envelope 10 through lead-in pins 24 has limited the applicability of the electron gun according to the '194 patent. The routing of two such comparatively high voltages through the lead-in pins has typically required an elaborate socket, indicated schematically by 42 in combination with base 22 and associated lead-in pins 24. The close adjacency of lead-in pins 24, and the wide range of potentials thereon has made it necessary to devise tube socket-base combinations capable of shielding the lead-in pins one from the other. Isolative means have included insulative barriers or walls molded as part of the socket and base to extend prospective arc paths. Sockets have also comprised non-destructive arcing paths in their structure, and arc-quenching means embodied in the socket and base combination. It has also often been necessary to introduce potting compounds into the tube base to eliminate arc-prone air paths between leads. This complexity of the socket and base combination adds to manufacturing costs.

The requirement for two base-introduced high-voltage potentials presents a further disadvantage in that an electron gun requiring such potentials can be used only in receivers having special power supply circuits adapted specifically for their use. Thus, the use of the gun of the '194 patent, despite its marked benefits, has been denied to a large segment of the television set population which lacks the necessary power supply and base-socket provisions. This denial encompasses otherwise excellent "older" receivers produced prior to the inception of the gun of the '194 patent. An example is the type of television chassis designed for a tube incorporating a gun with a bipotential lens which requires only two voltages in the high range—a single voltage of, typically, 8 or 9 kilovolts, introduced through the base, and a voltage of 30 kilovolts introduced through the funnel.

PRIOR ART STATEMENT

The prior art provides numerous examples of electro-optical lenses comprising a plurality of apertured discs, or "plates." Typical examples included those found in U.S. Pat. No. 2,859,378 to Gundert et al, which discloses a lens comprising a plurality of individual, electrically conducting plates mounted in spaced parallel relationship. The plates are apertured and are impressed with voltages such that a center group of plates is excited at a relatively low potential and the remaining plates from the center toward both ends are excited at successively higher voltages. In effect, this is a unipotential-type-lens of a design which is deemed to be commercially impractical.

Campbell—U.S. Pat. No. 3,932,786 discloses a multiple beam electron gun having a wide focusing lens gap. The lens gap has a plurality of metal elements, spaced therein, each element of which has a successively greater voltage applied to it. The application of the voltages creates an electrostatic field which focuses a plurality of beams generated by the gun. The plurality of metal elements is shown as comprising metal plates spaced in a gap between a first accelerating and focus electrode having a lower potential, and a second accelerating and focus electrode havine a higher potential. Each plate is connected to a tap on an adjacent voltage divider connected between the two electrodes so that each plate has a successively higher potential thereon. It is stated that the resulted focusing lens has the same properties as a large aperture electron focusing lens. The inclusion of the plates allegedly stabilizes the field permitting a large focusing gap to increase the focal length of the lens, while reputedly minimizing external interference with acceptable limits.

In U.S. Pat. No. 3,651,359, Miyaoka discloses a single-gun, plural beam cathode ray tube of the type in which the plurality of beams are made to intersect each other at a location in the tube between the beam-producing means and the screen. A focusing lens for focusing all the beams on the screen is disclosed which is made up of a plurality of lens components arranged in axial succession and defining an optical center of the focusing lens disposed within the latter. In one embodiment, the main focusing lens is constituted by seven successive, axially arranged electrodes G3, G4, G5, G6, G7, G8, and G9 which are connected, in alternating order, to sources of high and low potentials to establish electron lens fields which form lens components $Lm_1$ and $Lm_2$ around the axis of electrodes G4 and G8, and a third lens component $Lm_3$ around the axis of electrode G6. Any optical aberration imparted to the beams in passing through the first lens component is presumptively fully compensated for by the succeeding lens component. Since there are three lens components in the embodiment, it is said that the necessary focusing power can be achieved with lens components that each have further reduced power, thereby to minimize the optical aberrations imparted to the beams, especially to the outermost beams, in passing through the central lens component $Lm_3$ along paths at angles to the optical axis. Another embodiment comprises four such lens components.

Nakamura, in U.S. Pat. No. 3,702,950, discloses an electrostatic focusing-type television picture tube wherein a plurality of ring-shaped metal plates are successively coaxially stacked to form a lens assembly with the plates being separated by relatively small spaces. This lens is placed between the first accelerating electrode and a fluorescent screen, whereby a periodic electric field is produced. It is said that a lens effect of a main lens which is apparently a unitary system is provided. The system is presumed to be substantially free of aberration.

OBJECTS OF THE INVENTION

1. It is a general object of this invention to improve the performance of certain electron guns used in television cathode ray picture tubes.

2. It is another general object to improve the performance and increase the utility of television cathode ray tube electron guns having the extended field lens.

3. It is a less general object to make it possible to simplify circuit design of television receivers having extended field electron guns.

4. It is a more specific object of the invention to reduce the number of high voltage leads entering the base of cathode ray tubes having guns with the extended field lens, thus making it possible to simplify the base-socket assembly.

5. It is another specific object of this invention to make it possible to retrofit with extended field electron guns those television receivers designed for certain bipotential-type electron guns.

BRIEF DESCRIPTION OF THE DRAWINGS

The features of the present invention which are believed to be novel are set forth with particularity in the appended claims. The invention, together with further objects and advantages thereof, may be best understood, however, by reference to the following description taken in conjunction with the accompanying drawings in which:

DESCRIPTION OF THE PREFERRED EMBODIMENTS

Figure 3:
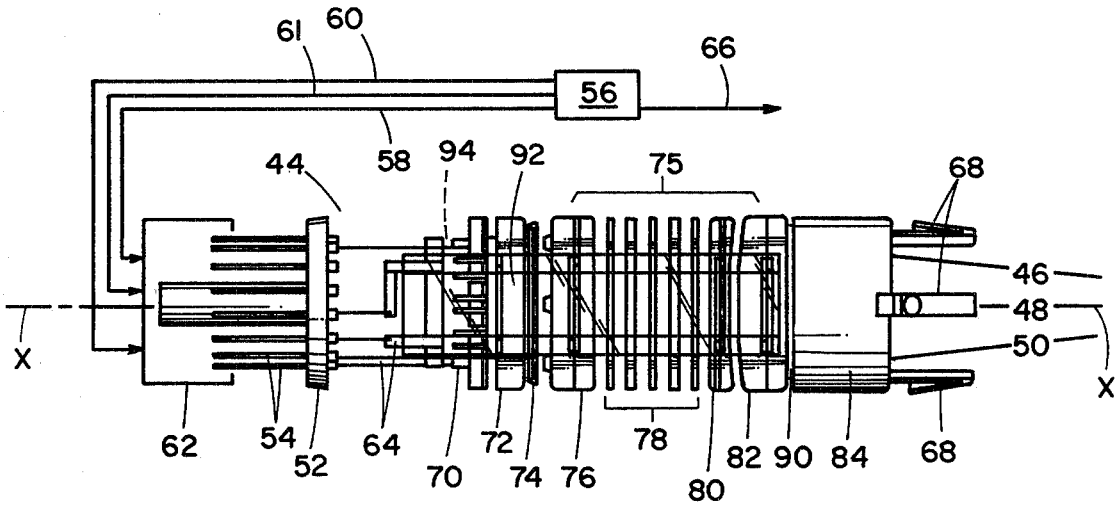
FIG. 3 is an assembled top view of a unitized, in-line gun according to the present invention.

FIG. 3 is an assembled view of a three-beam, unitized, in-line electron gun incorporating the present invention, and suitable for use in color television cathode ray tubes. Electron gun 44 produces three co-planar, focused beams of electrons 46, 48 and 50, each of which is formed, shaped and directed to selectively energize cathodoluminescent phosphor target elements on the screen of the associated picture tube (not shown).

A cathode ray tube base 52 provides a plurality of lead-in pins 54 for introducing into the envelope of the cathode ray tube certain television video signals, as well as certain voltages for filament energizing, and for electron beam forming and focusing. A power supply 56, illustrated schematically, develops a predetermined pattern of voltages for application to the components of electron gun 44 as will be described. Power from power supply 56 is routed directly to electron gun 44 through a plurality of external electrical leads. Lead 58 indicates the conveying of the aforementioned voltages for filament energizing. Lead 60 conveys a relatively low applied voltage, and lead 61 a relatively intermediate applied voltage for operation of electron gun 44. Leads 58, 60 and 61 are shown as providing voltages to gun 44 through socket 62 and base 52, both shown highly schematically. Distribution of the voltages to the several electrodes of gun 54 is by means of a plurality of internal electrical leads; typical leads are indicated by 64.

Power supply 56 also supplies a relatively high voltage; e.g., in the range of 25 to 35 kilovolts through a lead 66 to a cathode ray tube "anode button" located in the funnel of the tube. The anode button is in electrical contact with a thin coating of electrically conductive material deposited on the inner surface of the cathode ray tube funnel. This relatively high voltage is in turn routed to the electron gun 44 by metallic gun centering springs 68.

Gun 44 has a lower end, or "tetrode" section, which produces three separate beam cross-overs (not shown), one for each of the three co-planar beams 46, 48 and 50. The elements comprising this section include three discrete unitized cathode means 70 and utilized first and second grid means 72 and 74. This tetrode section does not constitute, per se, an aspect of this invention, but is described and claimed in referent copending application Ser. No. 694,614.

The beam cross-overs are imaged on the screen of the cathode ray tube by a low-aberration, low-magnification main focus lens means 75, indicated by the bracket, to form at a distance three electron beam spots which are small even at high beam currents. Main focus lens means 75 may comprise at least a first, second and third electode means and preferably comprises, in sequence, first electrode means 76, second electrode means 78, third electrode means 80 and fourth electrode means 82. Second electrode means 78 is indicated as having in this embodiment of the invention, five elements. Structural information relating to electrode 78 and other details according to the invention will be provided infra.

The electrode means of the main focus lens means 75 receive a predetermined pattern of applied voltages including a relatively low applied voltage, a relatively intermediate applied voltage applied to first electrode means 76 and third electrode means 80, and a relatively high applied voltage applied to fourth electrode means 82 which is conducted through snubber springs 68. Main focus lens means 75 establishes a single, continuous electrostatic field having an axial potential distribution which, at all times during tube operation, decreases smoothly and monotonically from a relatively intermediate axial potential to a relatively low intermediate axial potential spatially located at the lens intermediate position. This relatively low intermediate axial potential is kilovolts lower than the relatively intermediate axial potential but kilovolts higher than the relatively low applied voltage. The axial potential of main focus lens 75 then increases smoothly, directly and monotonically from the relatively low-intermediate axial potential to a relatively high axial potential. This relatively high axial potential is many kilovolts higher than the relatively intermediate axial potential. The potential difference between each of the electrode means establishes significant main focusing field components.

Typical potentials on the electrodes of electron gun 44 shown by FIG. 3 used for exemplary purposes in the description of the subject invention may, for example, be as follows. Cathode means 70 may have a varying voltage thereon; for example, from 0 to 150 volts. First grid means 72 may be at ground potential, while the potential of second grid means 74 may be 1 kilovolt. The relatively intermediate applied voltage applied to first electrode 76 and third electrode 80 may be a voltage in the range of 7 to 15 kilovolts. The relatively low applied voltage may be a voltage in the range of 0 to 2 kilovolts. The potential on the fourth electrode means is the same as the potential on the aforedescribed inner conductive coating; that is, in the range of 25 to 35 kilovolts. The potentials on second electrode means 78 according to the invention will be described infra.

Convergence of outer beams 46 and 50 inwardly to a common point of landing with central beam 48 may be accomplished by a slight angling of the two opposing planoparallel faces between electrodes 80 and 82. The angles extend outwardly and forwardly relative to the gun's central axis X—X. The convergence electrode concept per se does not constitute a part of this invention, but is described and fully claimed in U.S. Pat. No. 4,058,753, assigned to the assignee of this invention.

In the unitized, in-line gun described in this disclosure, unitized grids and electrodes 72, 74, 76, 80 and 82 have on each side thereof at least one pair of widely spaced, relatively narrow claws embedded at widely spaced points on wide beads 92 and 94. This structural concept does not constitute, per se, an aspect of this invention, but is described and claimed in U.S. Pat. No. 4,032,811 assigned to the assignee of this invention.

Figure 4:
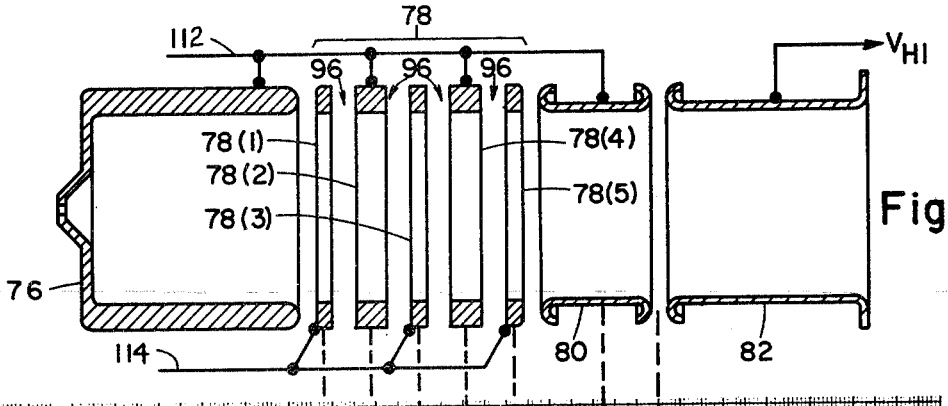
FIG. 4 is a schematic view in section of the main focus lens of an electron gun having a composite electrode according to the invention.
Figure 5:
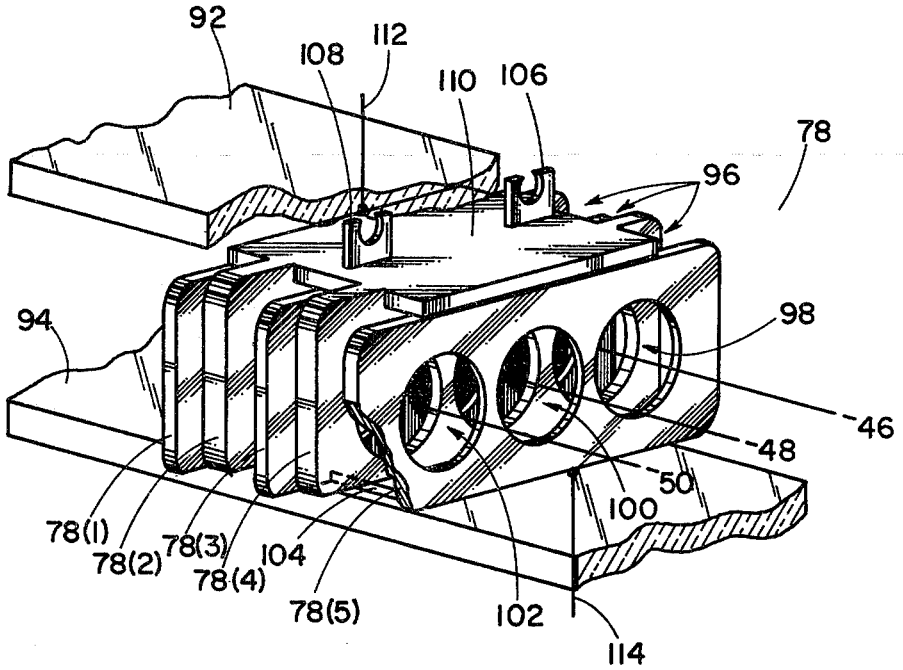
FIG. 5 is a view in perspective of an embodiment of a composite electrode according to the invention; and, FIGS. 6, 7 and 8 are plots showing the potential distribution relative to the axis of the main focus lens of an electron gun according to the invention; the spatial relationship with the electrodes and elements of the main focus lens shown by FIG. 4, is indicated.

The electron gun according to the invention is characterized by the synthesizing of the aforedescribed relatively low-intermediate axial potential. The means for synthesizing is the second electrode means 78 which comprises a composite electrode made up of an odd-number plurality of apertured elements separated by gaps. An embodiment of a composite electrode according to the invention having five elements is shown schematically by FIG. 4, and is represented in perspective in FIG. 5. It is to be noted that the depictions of FIGS. 4 and 5 are exemplary only and are not intended to be in any way limiting.

Composite electrode 78 according to the invention is represented in the figures as being made up of an odd-number plurality of apertured elements 78(1), 78(2), 78(3), 78(4) and 78(5) separated by gaps or "spaces" 96 as shown. Elements 78(1)–78(5) are shown in FIG. 5 as having apertures 98, 100, and 102 for passage of beams 46, 48, and 50 as indicated. The structure of electrode 78 shown by FIG. 5 represents only one possible configuration; other means of constructing such an electrode will readily suggest themselves to those skilled in the art. Even numbered elements 78(2) and 78(4) are shown as being attached to a plate 110 to which in turn is shown as being attached a pair of widely spaced, relatively narrow claws 106, 108; these claws are embedded at widely spaced points on wide bead 92. A plate 104 is similarly attached to odd-numbered elements 78(1), 78(3) and 78(5) for their retention. Plate 104 has claws (not shown) similar to claws 106 and 108 extending from plate 110. These claws are embedded in wide bead 94. It is to be noted that this representation is exemplary only, and is not in any way limiting.

Even-numbered elements 78(2) and 78(4) have the aforedescribed relatively intermediate applied voltage thereon; the voltage is shown as being conducted to the even-numbered elements by electrical conductor 112. The odd-numbered elements; that is elements 78(1), 78(3), and 78(5) have the aforedescribed relatively low applied voltage thereon; this voltage is indicated as being conducted to the odd-numbered electrodes by electrical conductor 114. The spacings of elements 78(1)–(5) of composite electrode 78, and the number of the elements, the aperture sizes and configurations of the elements, and the periodic applied voltages thereon are such as to produce according to the invention the relatively low-intermediate axial potential in non-periodic form at the lens intermediate position.

A significant benefit provided by the invention lies in the fact that only one "high" voltage need be introduced through the base of the tube; that is, only the relatively intermediate voltage in the 7 to 15 kilovolt range. As a result, the base-socket structure can be made less complex and costly, and a tendency toward arcing in that area greatly reduced. Further, the circuit of power supply 56 can be simplified in that one less high voltage need be supplied. Similarly, the high voltage conductor between power supply 56 and the base-socket assembly 52–62 can also be simplified in that only a single high-voltage conductor to the assembly is required.

Another salient benefit, and one preponderating in importance, is the fact that the extended field lens gun according to the '194 patent, with its improvement in resolution, can be used in television receivers designed for cathode ray tubes with bipotential electron guns, which require only a single high-voltage conductor entering through the base.

It will be observed that the discrete elements of the composite electrode 78 are shown in this embodiment as comprising "aperture" electrodes. The aperture electrode is essentially a flat sheet suitably apertured to form an electrode. Aperture electrodes afford an electro-optical benefit in that an aperture in such an electrode produces a lens which appears to the beam passing therethrough to be of larger diameter than the lens produced by the beam-passing aperture of the well-known cylinder electrode. The invention is not limited to the use of aperture electrodes; cylindrical or other electrode configurations can as well be used.

As noted, the succession of voltages applied to elements 78(1)–78(5) of the composite electrode 78 shown by FIGS. 4 and 5 may be, according to the invention, a succession, for example, of kilovolt potentials of 1-8-1-8-1, respectively, to produce the relatively low-intermediate axial potential in non-periodic form, all according to the invention.

The axial potential at any point Z is given by the formula for the axial potential of two coaxial equal diameter electrodes separated by a distance s, wherein:

$$V_A(z) = \frac{V_1 + V_2}{2} + \left(\frac{V_2 - V_1}{2ws}\right) \log \frac{\cosh wz}{\cosh w(z - s)}, \quad (1)$$

where $V_a$ is the potential on the axis, and $V_1$ and $V_2$ are the potentials on the two electrodes. This formula is set forth in the text *Electron Beams, Lenses, and Optics* by A. B. El-Kareh and J. C. J. El-Kareh; New York: Academic Press, 1970. The formula is numbered 3.97 and appears in chapter 3 entitled "An Analytical Determination of Electrostatic Fields."

Where there are more than two elements, as in composite electrode 78 according to the invention shown as having five elements, the principle of superposition is utilized wherein the relatively low-intermediate axial potential at each point along the axis is derived from the sum of the contributions from the potential difference at each gap taken separately according to the formula $$V_A(z) = \sum_{i=1}^{N} \left\{ \frac{V_i + V_{i+1}}{2} + \left(\frac{V_{i+1} - V_i}{2ws_i}\right) \log \frac{\cosh wz}{\cosh w(z - s_i)} \right\}, \quad (2)$$

where $V_i$ is the potential on the $i^{th}$ element; s is the space between the $(i+1)^{th}$ and $i^{th}$ elements, and N is the total number of grids comprising the composite electrode.

Figure 1:
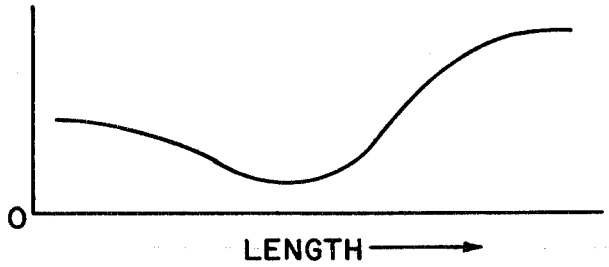
Fig. 1 PRIOR ART
FIG. 1 is a diagrammatical representation of the axial potential distribution-versus-length of the electron gun according to the referent '194 patent.
Figure 2:
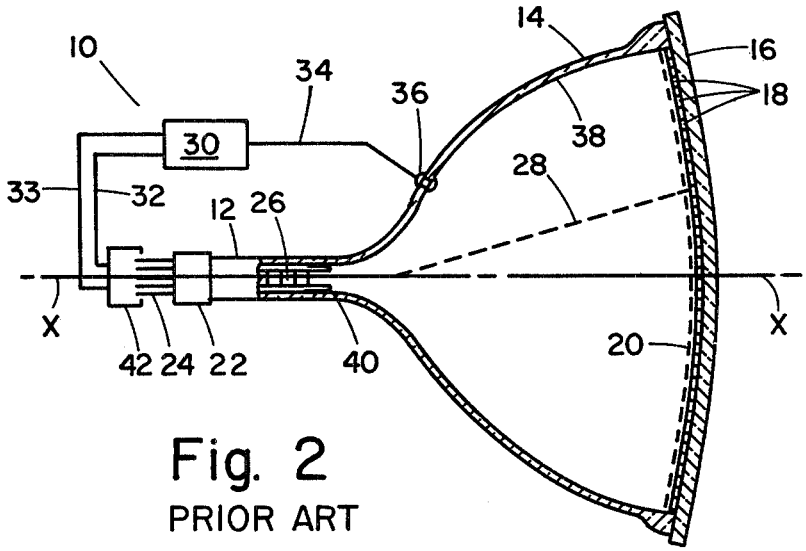
Fig. 2 PRIOR ART
FIG. 2 is a schematic side sectional view of a prior art color cathode ray tube and its interconnections with an associated power supply.

By appropriate choice of the thicknesses of the elements, spacings between the elements, the configuration of the elements, and the potentials on the elements, it is possible to synthesize according to the invention a smooth non-periodic relatively low-intermediate axial potential distribution similar to the distribution for the electron gun according to U.S. Pat. No. 3,995,194, shown by FIG. 1.

Figure 6:
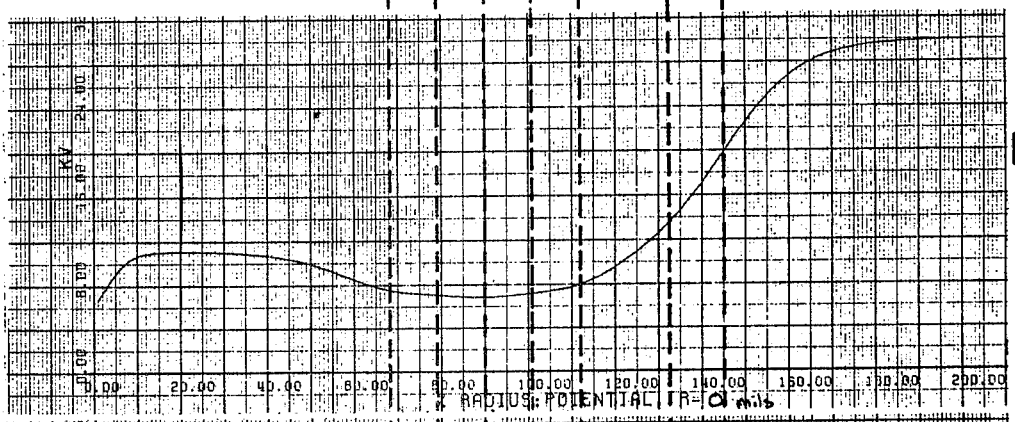
Figure 7:
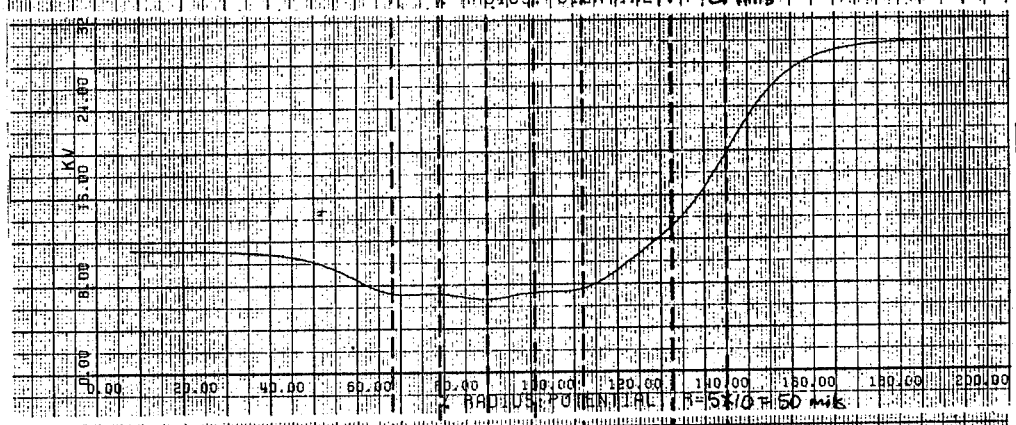
Figure 8:
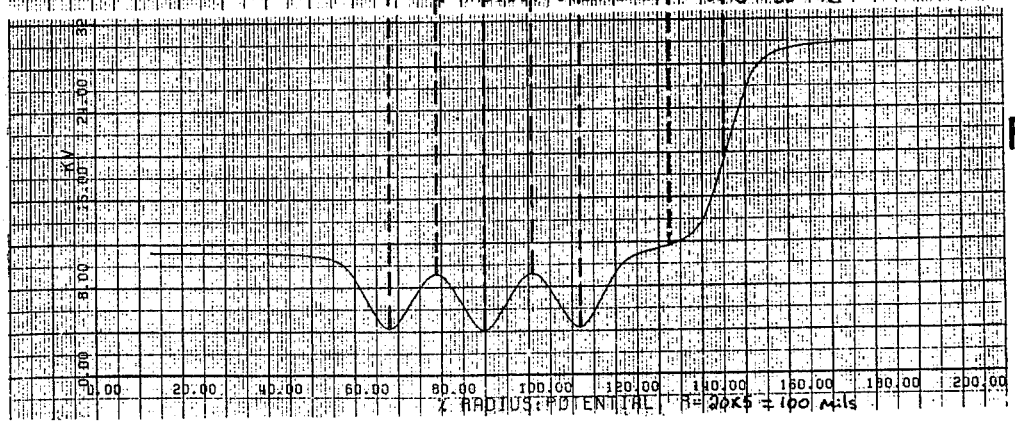

The effect of the application of the principle of superposition to a five-element composite electrode according to the invention is illustrated diagrammatically by FIG. 4 in conjunction with the associated plots of FIGS. 6, 7, and 8. The abscissa of each plot represents the distance along the axis of the gun and the ordinate represents the potential in kilovolts. The axial potential distribution shown by FIG. 6 is that of the gun according to the invention as measured at zero mils distance from the axis; the close conformance of the axial potential distribution to that of the gun of the '194 patent shown by FIG. 1 will be noted.

FIG. 7 represents the axial potential distribution taken at a distance 50 mils from the axis of the gun. It will be seen that the curve generated by composite electrode 78 tends toward periodic in nature in this instance, but sill remains substantially like that shown in FIG. 6. The effect of the electrode 78 upon a beam 100 mils from the axis is shown by FIG. 8; the waveform will be seen to be definitely periodic. However, the electrons comprising the electron beams remain primarily in the regions represented by FIGS. 6 and 7 and never venture into the region represented by FIG. 8. Hence the net effect is a smooth, non-periodic, relatively low-intermediate axial potential, according to the invention.

The number of electrode elements shown by FIGS. 4 and 5 is indicated as being five in number. This five-element configuration is in no way a limitation; the number of elements of a composite electrode according to the invention can be in the range from 3 to 21. A number of electrodes greater than five provides the benefit of reduced spherical aberration and smaller spot size. However, increasing the number of elements also increases the complexity of the electrode and increases the length of the gun. So a trade-off must be made with regard to these factors—a trade-off dictated by the needs of the skilled-in-the art gun designer in seeking optimum use of the invention.

Figure 9:
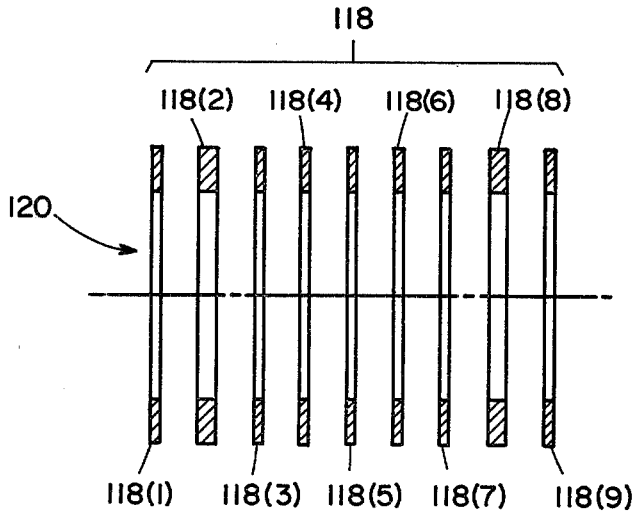
FIG. 9 is a schematic view in section of another embodiment of the composite electrode according to the invention.

A composite electrode having nine elements will provide very effective performance in terms of small, symmetrical beam spots. An electrode 118 having nine elements 118(1)–118(9) is shown by FIG. 9. Electrode 118 is indicated as having an aperture 120 therethrough for passage of a beam.

It will be noted from FIGS. 4 and 5 that the odd-numbered elements 78(1), 78(3) and 78(5) of the five-element composite electrode 78 are of different thicknesses than the even-numbered electrodes 78(2) and 78(4). The thickness of an electrode or an element is defined as the dimension taken along an axial direction. It will be noted in the embodiment indicated by FIGS. 4 and 5 that the even-numbered elements are shown to be approximately twice as thick as the odd-numbered elements, although this is in no wise a limitation.

The determination of the relative thicknesses of the elements, and the location of those elements of different thickness in the train of elements comprising a composite electrode according to the invention, can be accomplished by computer analysis means known to those skilled in the art of gun design. An iterative program is used whereby different configurations of the elements are tried and their axial potential and corresponding aberrations are computed to arrive at the configuration that is least aberrating. For example, in a succession of elements $E_1$–$E_5$ having spaces $S_1$–$S_4$, the iterative program provides for the following—

(a) vary $E_1$ from 10 mils to 50 mils by 1 mil increments;

(b) vary $S_1$ from 40 mils to 60 mils 1 mil increments;

(c) vary $E_2$ from 10 mils to 60 mils by 1 mil increments; etc.

By this trial and error method, the configurations of the elements of a composite electrode according to the invention are arrived at.

As noted, the even-numbered elements adjacent to the first and last elements of electrode 118 shown by FIG. 9, that is, elements 118(2) and 118(8) adjacent to elements 118(1) and 118(9), respectively, are shown as being appreciably thicker than all other elements. The relative thickness or thinness of the elements are factors determined from the aforedescribed formula (2).

In terms of actual dimensions, elements 118(1), 118(3)–(7), and 118(9) of the composite electrode 118 shown by FIG. 9 may be about 10 mils thick, while elements 118(2) 118(8) may be about 20 mils thick. The spacing between the electrodes is preferably in the range of 35 to 60 mils. These figures are not limiting but are provided only for exemplary purposes. Dimensions, as derived either theoretically or empirically, may be varied considerably from the examples shown and described and still fall within the spirit and scope of the invention.

In lieu of varying the relative thicknesses of the elements of a composite electrode according to the invention, the diameters of the apertures of selected elements may be caused to differ from the diameter of apertures of adjacent elements. For example, with regard to elements 118(2) and 118(8) of composite electrode 118 shown by FIG. 9, in lieu of variance in thickness, the subject elements may be of the same thickness; however, the diameters of the apertures may be made smaller than the diameters of the apertures of all other elements. Making the diameters smaller provides the same effect as making the elements thicker. However, any variance in the diameter of an aperture in a discrete electrode in an electron gun presents a major problem in production due to the fact that gun components are assembled by mandrelling. As a result, electrodes in the middle of the stack of electrodes having larger diameters cannot be easily coaxially aligned.

Many ways to accomplish the fabrication of composite electrodes according to the invention will suggest themselves to those skilled in the art of electron gun design. To cite only one example, each discrete section of the composite electrode may be formed by first forming the apertures in suitably shaped solid metallic stock by means such as broaching, then forming the individual plates by milling. The pair of claws that project from each of the sections may also be formed by the milling process; or, they may be attached by means such as welding. A very long composite electrode such as one having as many as 21 elements, may require pairs of claws at both ends of the electrode.

While particular embodiments of the invention have been shown and described, it will be obvious to those skilled in the art that changes and modifications may be made without departing from the invention in its broader aspects, and therefore, the aim of the appended claims is to cover all such changes and modifications as fall within the true spirit and scope of the invention.

We claim:

1. An electron gun for a television cathode ray tube for producing a focused beam of electrons, said gun comprising associated cathode means and grid means for producing a beam of electrons, and a low-aberration, low-magification main focus lens means comprising at least a first, second and third electrode means to form at a distance an electron beam spot which is small even at high beam currents, the electrode means of said main focus lens means receiving a predetermined pattern of applied voltages including a relatively low applied voltage, a relatively intermediate applied voltage applied to said first electrode means, and a relatively high applied voltage applied to said third electrode means, said main focus lens means establishing a single, continuous electrostatic field having an axial potential distribution which, at all times during tube operation, decreases smoothly and monotonically from a relatively intermediate axial potential to a relatively low-intermediate axial potential spatially located at a lens intermediate position; i.e., an axial potential which is kilovolts lower than said relatively intermediate axial potential but kilovolts higher than said relatively low applied voltage, and then increases smoothly, directly and monotonically from said relatively low-intermediate axial potential to a relatively high axial potential; i.e., a potential which is many kilovolts higher than said relatively intermediate axial potential, the potential difference between each of said main focus electrode means establishing significant main focusing field components, said gun being characterized by the synthesizing of said relatively low-intermediate axial potential, the means for said synthesizing being said second electrode means comprising a composite electrode made up of an odd-number plurality of apertured elements separated by gaps, the even-numbered ones of said elements having said relatively intermediate applied voltage thereon, and odd-numbered ones of said elements having said relatively low applied voltage thereon, the spacing of said elements of said composite electrode, and the number of said elements, the aperture sizes and configurations of said elements, and the periodic applied voltages thereon being such as to produce said relatively low intermediate axial potential in non-periodic form at said lens intermediate position.

2. The electron gun defined by claim 1 wherein said relatively intermediate applied voltage is a voltage in the range of 7 to 15 kilovolts, said relatively high applied voltage is a voltage in the range of 25 to 35 kilovolts, and said relatively low applied voltage to a voltage in the range of 0–2 kilovolts.

3. The electron gun defined by claim 1 wherein the number of said electrode elements of said composite electrode is in the range of three to twenty-one.

4. The electron gun defined by claim 1 wherein the number of said electrode elements of said composite electrode is five.

5. The electron gun defined by claim 1 wherein the even-numbered elements of said composite electrode adjacent to the first and last elements of said electrode are appreciably thicker than the others of said elements.

6. The electron gun defined by claim 1 wherein said elements of said composite electrode comprise aperture electrodes.

7. The electron gun defined by claim 1 wherein the diameters of the apertures of ones of said even-numbered ones of said elements of said composite electrode differ from the diameters of the apertures of said odd-numbered ones of said elements.

8. The electron gun defined by claim 1 wherein the diameter of the apertures of the even-numbered ones of said elements adjacent to the first and last elements of said composite electrode are smaller than the diameters of the apertures of the odd numbered ones of said elements comprising said electrode.

9. An electron gun for a television cathode ray tube for producing a focused beam of electrons, said gun comprising associated cathode means and grid means for producing a beam of electrons, and a low-aberration, low-magnification main focus lens means comprising at least a first, second, third and fourth electrode means to form at a distance an electron beam spot which is small even at high beam currents, the electrode means of said main focus lens means receiving a predetermined pattern of applied voltages including a relatively low applied voltage, a relatively intermediate applied voltage applied to said first and third electrode means, and a relatively high applied voltage applied to said fourth electrode means, said main focus lens means establishing a single, continuous electrostatic field having an axial potential distribution which, at all times during tube operation, decreases smoothly and monotonically from a relatively intermediate axial potential to a relatively low-intermediate axial potential spatially located at a lens intermediate position; i.e., an axial potential which is kilovolts lower than said relatively intermediate axial potential but kilovolts higher than said relatively low applied voltage, and then increases smoothly, directly and monotonically from said relatively low-intermediate axial potential to a relatively high axial potential; i.e., a potential which is many kilovolts higher than said relatively intermediate axial potential, the potential difference between each of said main focus electrode means establishing significant main focusing field components, said gun being characterized by the synthesizing of said relatively low-intermediate axial potential, the means for said synthesizing being said second electrode means comprising a composite electrode made up of an odd-number plurality of apertured elements separated by gaps, the even-numbered ones of said elements having said relatively intermediate applied voltage thereon, and the odd-numbered ones of said elements having said relatively low applied voltage thereon, the spacings of said elements of said composite electrode, and the number of said elements, the aperture sizes and configurations of said elements, and the periodic applied voltages thereon being such as to produce said relatively low intermediate axial potential in non-periodic form at said lens intermediate position.

10. A three-beam, unitized electron gun for a color television cathode ray tube for producing three coplanar focused beams of electrons, said gun comprising associated three discrete unitized cathode means and three discrete unitized first and second grid means for producing said beams of electrons, and a low-aberration, low-magnification main focus lens means comprising unitized first, second, third and fourth electrode means, said main focus lens means establishing a single, continuous electrostatic field having an axial potential distribution which, at all times during tube operation, decreases smoothly and monotonically from a relatively intermediate axial potential to a relatively low-intermediate axial potential spatially located at a lens intermediate position; i.e., an axial potential which is kilovolts lower than said relatively intermediate axial potential but kilovolts higher than said relatively low applied voltage, and then increases smoothly, directly and monotonically from said relatively low-intermediate axial potential to a relatively high axial potential; i.e., a potential which is many kilovolts higher than said relatively intermediate axial potential, the potential difference between each of said electrode means establishing significant main focusing field components, said gun being characterized by the synthesizing of said relatively low-intermediate axial potential, the means for said synthesizing being said second electrode means comprising a composite electrode made up of an odd-number plurality of apertured elements separated by gaps, the even-numbered ones of said elements having said relatively intermediate applied voltages thereon, and the odd-numbered ones of said elements having said relatively low applied voltage thereon, the spacings of said elements of said composite electrode, the number of said elements, the aperture sizes and configurations of said elements, and the periodic applied voltages thereon being such as to produce said relatively low intermediate axial potential in non-periodic form at said lens intermediate position.

11. A three-beam, unitized electron gun for a color television cathode ray tube for producing three coplanar focused beams of electrons, said gun comprising associated three discrete unitized cathode means and three discrete unitized first and second grid means for producing said beams of electrons, and a low-aberration, low-magnification main focus lens means comprising unitized first, second, third and fourth electrode means, said main focus lens means establishing a single, continuous electrostatic field having an axial potential distribution which, at all times during tube operation, decreases smoothly and monotonically from a relatively intermediate axial potential to a relatively low-intermediate axial potential spatially located at a lens intermediate position; i.e., an axial potential which is kilovolts lower than said relatively intermediate axial potential but kilovolts higher than said relatively low applied voltage, and then increases smoothly, directly and monotonically from said relatively low-intermediate axial potential to a relatively high axial potential; i.e., a potential which is many kilovolts higher than said relatively intermediate axial potential, the potential difference between each of said electrode means establishing significant main focusing field components, said gun being characterized by the synthesizing of said relatively low axial potential, the means for said synthesizing being said second electrode means comprising a composite electrode made up of an odd-number plurality of apertured elements; namely five, separated by gaps, the even-numbered ones of said elements having said relatively intermediate applied voltage thereon, and the odd-numbered ones of said elements having said relatively low applied voltage thereon, and therein said even-numbered elements adjacent to the first and last elements are appreciably thicker than the others of said elements, the spacings of said elements of said composite electrode, the relative thickness of said elements, the configuration of said elements, and the periodic applied voltage thereon being such as to produce said relatively low-intermediate axial potential in non-periodic form at said lens intermediate position.

* * * * *